US009644406B2

(12) United States Patent
Liao

(10) Patent No.: US 9,644,406 B2
(45) Date of Patent: May 9, 2017

(54) WINDOW STOP DEVICE

(71) Applicant: ACCVAL L.L.C., Dover, DE (US)

(72) Inventor: Chen-Jui Liao, Dover, DE (US)

(73) Assignee: ACCVAL L.L.C., Dover, DE (US)

( * ) Notice: Subject to any disclaimer, the term of this patent is extended or adjusted under 35 U.S.C. 154(b) by 360 days.

(21) Appl. No.: 14/165,150

(22) Filed: Jan. 27, 2014

(65) Prior Publication Data

US 2014/0339836 A1 Nov. 20, 2014

(30) Foreign Application Priority Data

May 15, 2013 (TW) ..... 102209050 U

(51) Int. Cl.
*E05C 3/00* (2006.01)
*E05C 17/54* (2006.01)
*E05C 17/60* (2006.01)

(52) U.S. Cl.
CPC ..... *E05C 17/54* (2013.01); *E05C 17/60* (2013.01); *E05D 13/04* (2013.01); *E05Y 2800/692* (2013.01); *E05Y 2900/148* (2013.01); *Y10T 292/20* (2015.04)

(58) Field of Classification Search
CPC .... Y10S 292/15; Y10S 292/46; Y10S 292/56; Y10T 16/628; Y10T 16/6285; Y10T 16/61; E05C 3/12
USPC ..... 49/449, 451; 292/256
See application file for complete search history.

(56) References Cited

U.S. PATENT DOCUMENTS 2,405,251 A * 8/1946 Glaze ..... B65D 45/24 180/68.5
2,629,466 A * 2/1953 Nardulli ..... E05D 15/00 292/256
3,295,259 A * 1/1967 Dallaire ..... E05B 9/08 49/413
3,431,003 A * 3/1969 Kilpatrick ..... F21V 17/107 292/256
3,509,592 A * 5/1970 Schrock ..... A47B 95/02 16/412
3,756,641 A * 9/1973 Dugan ..... E05B 65/0894 24/486
3,938,839 A * 2/1976 Collier ..... E05B 65/0894 292/258
4,062,576 A * 12/1977 Jennings ..... E05B 65/0894 292/257
4,148,508 A * 4/1979 Adair ..... E05B 65/0894 292/258
4,171,835 A * 10/1979 Conley ..... E05B 65/0894 292/288
4,190,271 A * 2/1980 Hawkins ..... E05B 65/0894 292/145

(Continued)

*Primary Examiner* — Janet M Wilkens
(74) *Attorney, Agent, or Firm* — LeClairRyan

(57) ABSTRACT

A window stop device is adapted for limiting sliding movement of a window sash along a rail, and includes a restraining unit and a lever unit pivoting on the restraining unit between a locked position and an unlocked position. The restraining unit includes a pair of clamping members for flanking the rail. In the locked position, pressing arms of the lever unit press the clamping members, respectively, so that the clamping members clamp tightly the rail therebetween. In the unlocked position, the pressing arms are away from the clamping members so as to release the clamping members and permit sliding movement of the restraining unit along the rail.

8 Claims, 8 Drawing Sheets

(56) References Cited

U.S. PATENT DOCUMENTS

| | | | | | |
|---|---|---|---|---|---|
| 4,304,429 | A * | 12/1981 | Gist | E05B 65/0894 | 292/257 |
| 4,443,508 | A * | 4/1984 | Mehl | 16/86 A | |
| 4,937,979 | A * | 7/1990 | Liou | E05B 67/36 | 49/404 |
| 5,112,090 | A * | 5/1992 | Stogsdill | E05B 65/0894 | 292/1 |
| 6,487,752 | B1 * | 12/2002 | Mathews | E05F 5/003 | 16/86 A |
| D485,484 | S * | 1/2004 | McCoy | D8/343 | |
| 2004/0026934 | A1 * | 2/2004 | Boda | A47B 57/54 | 292/256 |
| 2008/0127567 | A1 * | 6/2008 | Nikkhah | E05B 65/0835 | 49/404 |
| 2011/0047885 | A1 * | 3/2011 | Chen | E05F 5/003 | 49/504 |

* cited by examiner

WINDOW STOP DEVICE

CROSS-REFERENCE TO RELATED APPLICATION

This application claims priority of Taiwanese Application No. 102209050, filed on May 15, 2013.

BACKGROUND OF THE INVENTION

1. Field of the Invention

The invention relates to a window stop device, particularly to a window stop device suitable for limiting a sliding movement of a window sash along a rail.

2. Description of the Related Art

A sliding window is commonly used in residential buildings due to its durability and weather proofing feature. The sliding window generally has two window sashes slidable on two rails. A window frame of the sliding window and frames of the sashes are generally made of aluminum for reduced weights and easy operability. Sometimes an additional metal grille window is also provided to prevent theft. However, the metal grille window not only hinders people from escaping in case of fire, but also negatively affects the appearance of a building, hence is sometimes not permitted. A window without a metal grille window possesses a potential danger as children may fall out from the window.

Therefore, it is important to limit the movement of the window sashes to prevent children from falling out, but still maintain air ventilation function of the window. U.S. Patent Application Pub. No. US 2011/0047885 A1 discloses a window stop that is affixed to the rail with screws. However, such design requires a specific tool to remove screws for uninstalling the window stop, and may cause dangerous delay in case of emergency.

SUMMARY OF THE INVENTION

Therefore, the object of the present invention is to provide a window stop device that can eliminate the aforesaid drawbacks of the prior art.

According to the present invention, there is provided a window stop device adapted for limiting sliding movement of a window sash along the rail. The window stop device includes a restraining unit and a lever unit.

The restraining unit has a pair of clamping members that are adapted for flanking the rail. The lever unit is connected to the restraining unit and includes a pair of pressing arms that are spaced apart from each other. The lever unit is movable relative to the restraining unit between a locked position and an unlocked position.

In the locked position, the clamping members are pressed respectively by the pressing arms to clamp tightly the rail therebetween so as to position the restraining unit relative to the rail.

In the unlocked position, the pressing arms are away from the clamping members so as to release the clamping members and to permit sliding movement of the restraining unit along the rail.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
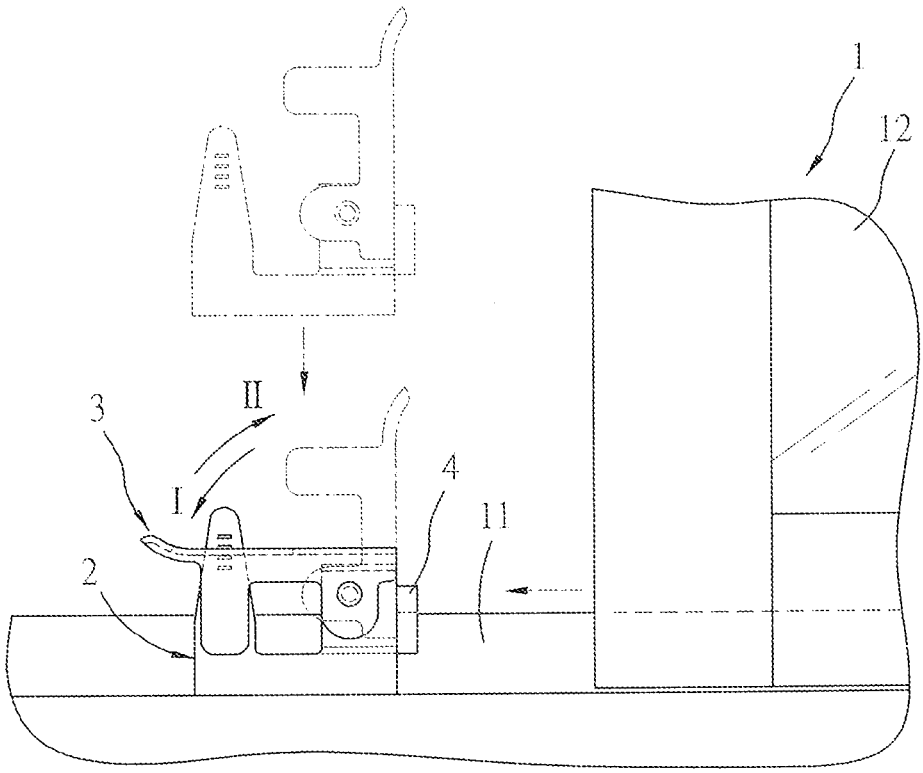
FIG. 1 is a fragmentary schematic view showing an assembly relationship between a window and the first preferred embodiment of a window stop device according to the present invention.

Before the present invention is described in greater detail, it should be noted that like elements are denoted by the same reference numerals throughout the disclosure.

Figure 2:
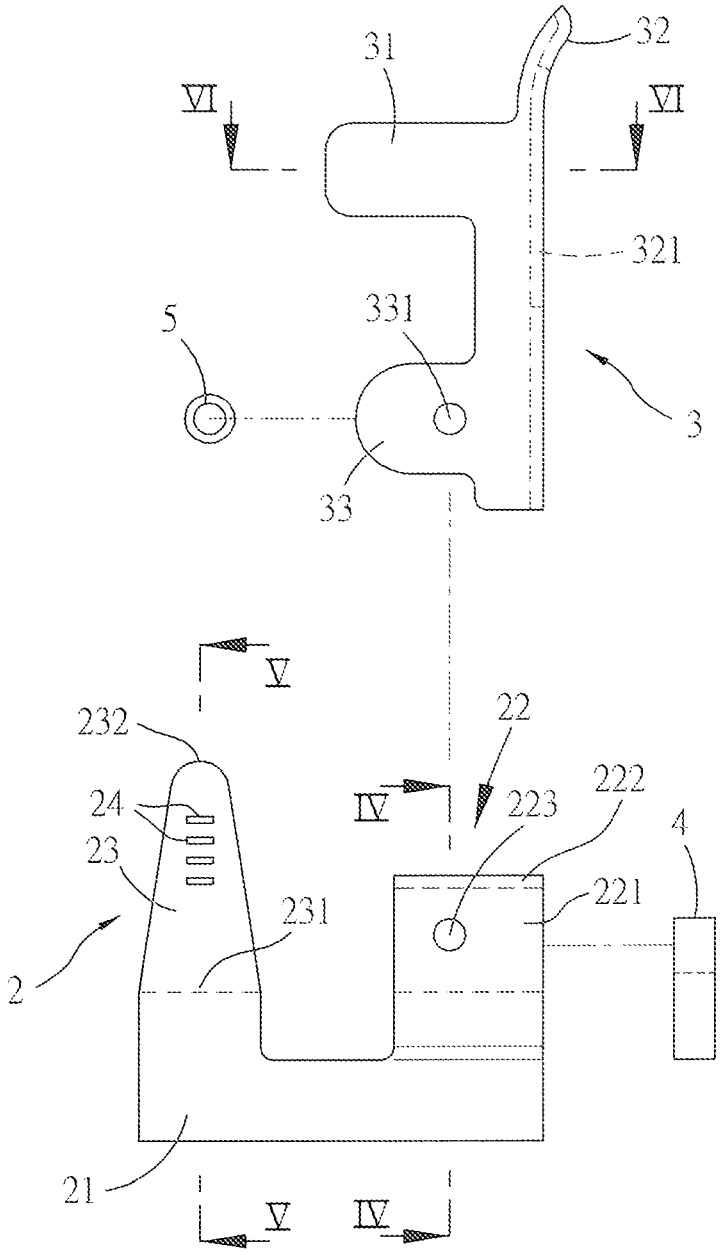
FIG. 2 is an exploded side view of the first preferred embodiment.
Figure 3:
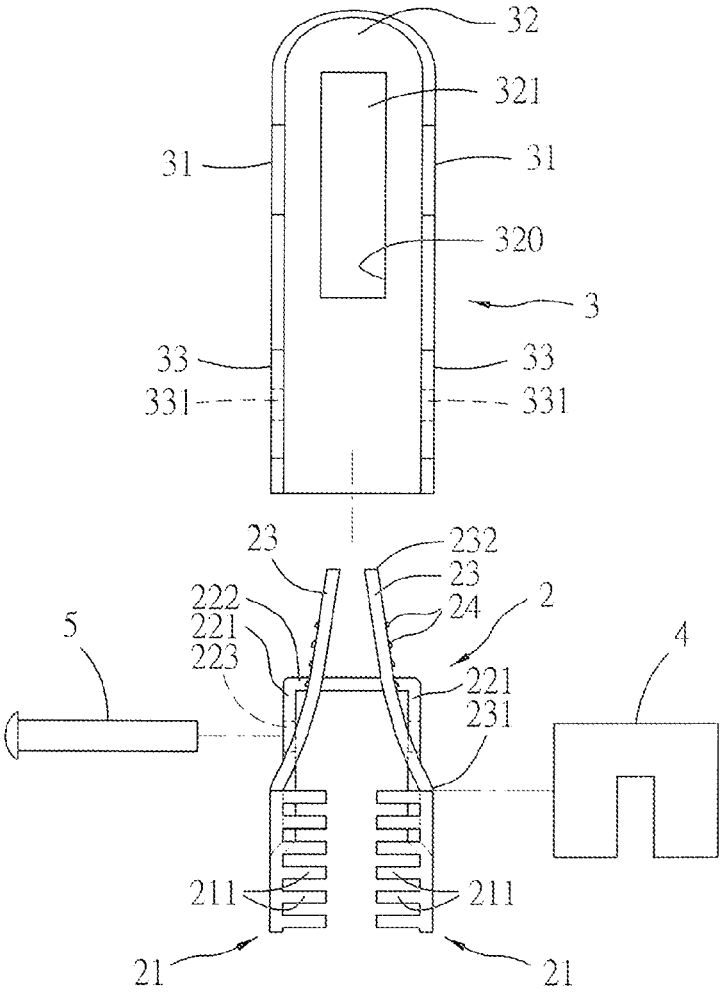
FIG. 3 is another exploded side view of the first preferred embodiment from another viewing angle.
Figure 4:
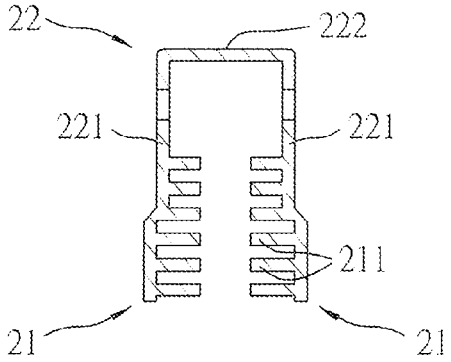
FIGS. 4 to 6 are cross-sectional views taken along lines IV-IV, V-V and VI-VI of FIG. 2, respectively.
Figure 5:
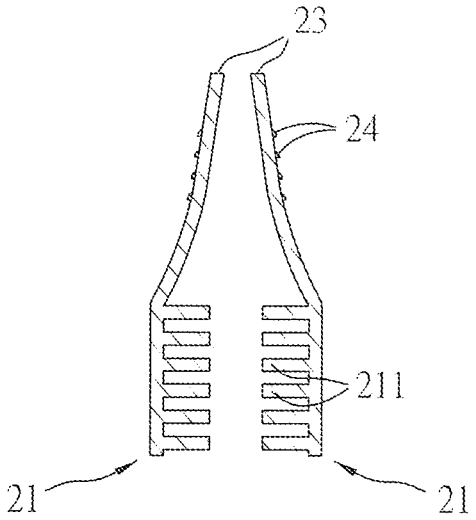

With reference to FIGS. 1, 2 and 3, a first preferred embodiment of a window stop device according to the present invention is adapted for limiting sliding movement of a window 1. For example, the window 1 is a horizontal sliding window with two rails 11 and two window sashes 12 respectively mounted on and slidable along the rails 11. For clearer illustration, FIG. 1 only shows one of the rails 11 and one of the sashes 12. The window stop device includes a restraining unit 2, a lever unit 3, a buffering member 4 and a pivot member With reference to FIGS. 2, 3, 4 and 5, the restraining unit 2 is narrow and elongated, and includes a pair of clamping members 21 adapted for flanking the rail 11 arid a connecting member 22 interconnecting the clamping members 21. The connecting member 22 has two spaced-apart side wails 221 connected respectively to the clamping members 21, and a connecting wall 222 that interconnects cop edges respectively of the side wails 221. The restraining unit 2 further includes two guiding members 23 that, are spaced apart from the connecting member 22 and that extend upwardly and respectively from the clamping members 21, and a plurality of ribs 24 that are spaced apart from each other. Each of the ribs 24 is disposed on and projects outwardly from a corresponding one of the guiding members 23. Each of the side walls 221 of the connecting member 22 is formed with a first pivoting hole 223. In this embodiment, each of the clamping members 21 includes a plurality of holding plates 211 that may be made of metal, plastic or other flexible materials such as rubber and silicon.

Figure 6:
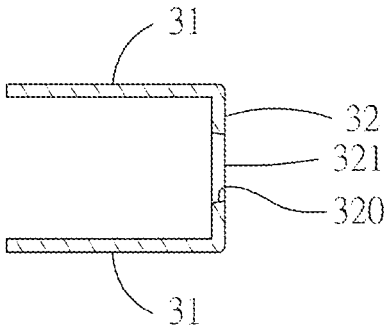

With reference to FIGS. 2, 3 and 6, the lever unit 3 includes a pair of pressing arms 31 spaced apart from each other, a connecting arm 32 interconnecting the two pressing arms 31, and two base arms 33 spaced apart from each other and connected to the connecting arm 32 away from the pressing arms 31. The connecting arm 32 has a hole-defining surface 320 defining a position hole 321. Each of the base arms 33 is formed with a second pivot hole 331. The pivot member 5 extends through the first pivot holes 223 of the connecting member 22 and the second pivot, holes 331 of the base arms 33 and pivotally connects the lever unit 3 to the restraining unit 2, thereby enabling the pressing arms 31 and the connecting arms 32 to pivot about the pivot member 5. The pivot member 5 is a rivet in this embodiment.

The buffering member 4 is connected to the restraining unit 2 at a position adjacent to the pivot member 5, and is adapted for abutting against and protecting the window sash 12 (see FIG. 1). In this embodiment, the buffering member 4 may be made of a flexible material such as rubber or silicon. However, in other embodiments, the buffering member 4 may be made of a plastic or metal material.

For easily guiding the guiding members 23 into the positioning hole 321 of the connecting arm 32, each of the guiding members 23 has a fixing end section 231 connected to the respective one of the clamping members 21, and a free end section 232 distal from the fixing end section 231. A distance between the guiding members 23 at the free end sections 232 is smaller than a width of the positioning hole 321. The distance gradually increases from the free end sections 232 toward the fixing end sections 231, and becomes larger than the width of the positioning hole 321 at the fixing end sections 231.

The operation for mounting the window stop device of the first preferred embodiment is described in the following.

With reference to FIG. 1, the window stop device is positioned in a predetermined location on the rail 11 where a distance between the window sash 12 and a window frame (not shown) is determined to prevent children from falling out without blocking air ventilation through the opened window 1. The lever unit 3 is movable relative to the restraining unit 2 between a locked position (indicated by solid lines) and an unlocked position (indicated by dashed lines).

Figure 7:
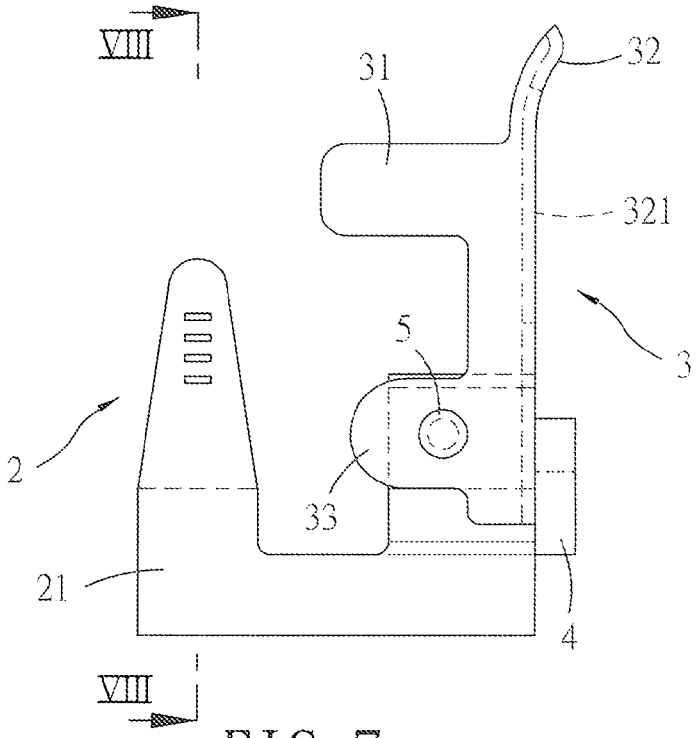
FIG. 7 is a side view of the first preferred embodiment when a restraining unit is in an unlocked position.
Figure 8:
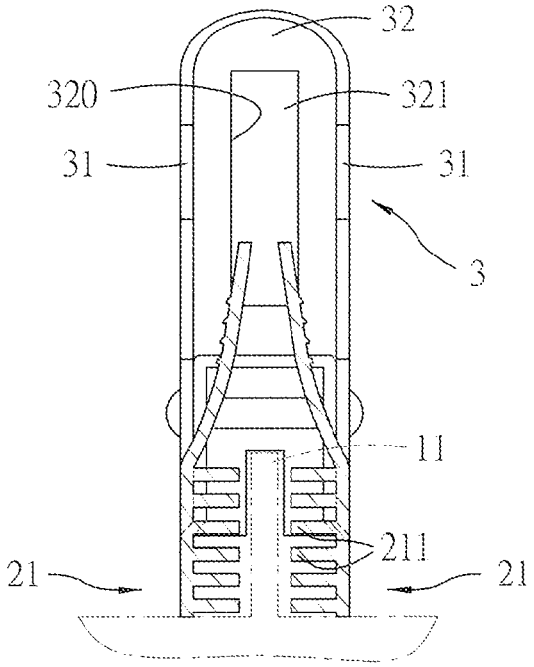
FIG. 8 is a cross-sectional view taken along line VIII-VIII of FIG. 7.

When the lever unit 3 is in the unlocked position, as shown in FIGS. 7 and 8, the pressing arms 31 of the lever unit 3 are away from the clamping members 21 of the restraining unit 2 so as to release the clamping members 21 from clamping the rail 11 and permit sliding movement of the restraining unit 2 along the rail 11.

Figure 9:
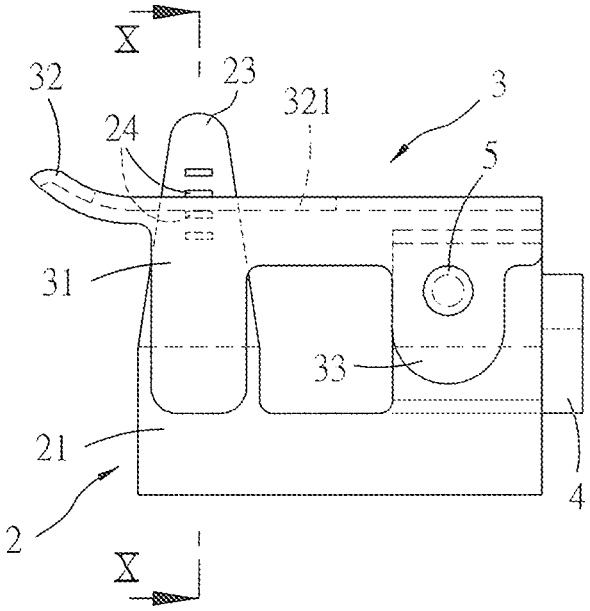
FIG. 9 is a side view of the first preferred embodiment when the restraining unit is in a locked position.
Figure 10:
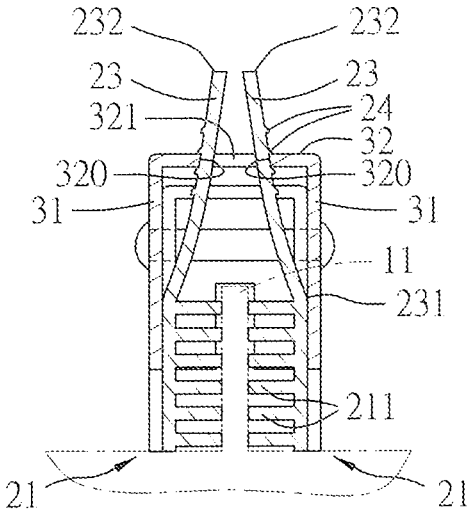
FIG. 10 is a cross-sectional view taken along line X-X of FIG. 9.

When the lever unit 3 is pivoted in a direction (I) to the locked position, as shown in FIGS. 9 and 10, the clamping members 21 are pressed respectively by the pressing arms 31 to clamp tightly the rail 11 therebetween. In particular, the holding plates 211 of line clamping members 21 tightly abut against the rail 11. At the same time, upper parts the guiding members 23 pass through, the positioning hole 321 of the connecting arm 32 and abut against the hole-defining surface 320, such that the connecting arm 32 engages and is positioned between, an adjacent pair of the ribs 24 on each of the guiding members 2 3, and the lever unit 3 clamps on the restraining unit 2, making the clamping members 21 clamp the rail 11 relatively tighter. The lever unit 3 can be released from the locked position by pressing the two free end sections 232 of the guiding members 23 at the same time, so that the two free end sections 232 are moved toward each other and the connecting arm 32 is no longer engaging the ribs 24, and then by pivoting the lever unit 3 in a direction (II) to the unlocked position as shown in FIGS. 7 and 8.

Figure 11:
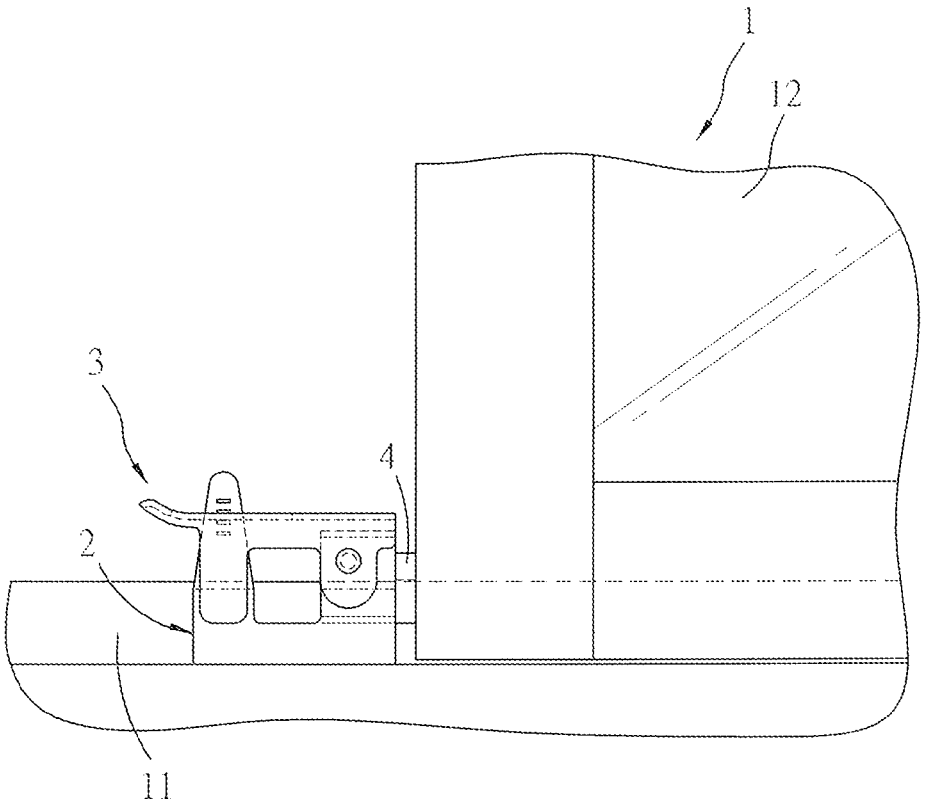
FIG. 11 is a fragmentary schematic view illustrating the restraining unit in the locked position for limiting a sliding movement of a window sash.

With reference to FIG. 11, when the lever unit 3 is in the locked position and the restraining unit 2 clamps tightly the rail 11, the window sash 12 can only slide horizontally until abutting against the buffering member 4 so that the sliding movement of the window sash 12 is limited to prevent children from crossing over and falling out of the window 1, without affecting the air ventilation.

With reference to FIGS. 1 and 8, comparing to the window stop disclosed in U.S. Patent Application Pub. No. US 2011/0047885 A1, there is no requirement of any tool to mount and dismount the window stop device of this embodiment according to the present invention. A user can simply dismount the window stop device by pressing the free end sections 232 of the guiding members 23 toward each other, and by pivoting the lever unit 3 in the direction (II) to an unlocked position. This simple procedure effectively reduces the complexity and time to dismount the window stop device in case of emergencies. The reliability and dependability of the window stop device is improved, and the function of preventing children from falling out is ensured.

With reference to FIGS. 1, 2, 9 and 10, it should be noted that the window 1 may be manufactured with a tolerance in the thickness of the rails 11. When the thickness of the rail 11 is slightly greater than a standard rail thickness, the connecting arm 32 may be adjusted to engage and be positioned between a suitable and adjacent pair of the ribs 24 that are disposed on each of the guiding members 23 at a relatively higher position. Similarly, when the thickness of the rail 11 is slightly smaller than the standard rail thickness, the connecting arms 32 may be adjusted to engage and be positioned between another adjacent pair of the ribs 24 that are disposed on each of the guiding members 23 at. a relatively lower position. The distance between the clamping members 21 flanking the rail 11 may be adjusted with flexibility.

Although there are two guiding members 23 in this embodiment, a single guiding member 23 extending upwardly from one of the clamping member 21 is also viable. The single guiding member 23 of the restraining unit 2 passing through the positioning hole 321 of the connecting arm 32 of the levering unit 3 can still achieve the clamping result when the lever unit 3 is pivoted to the locked position.

Figure 12:
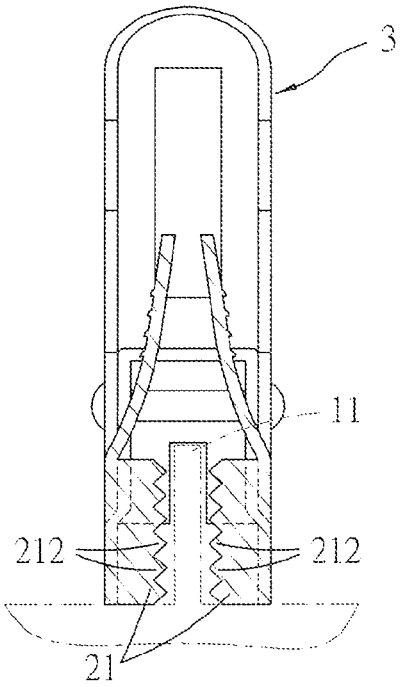
FIG. 12 is a cross-sectional view of a second preferred embodiment of the window stop device according to the present invention.

With reference to FIG. 12, a second preferred embodiment of the window stop device according to the present invention is similar to the first preferred embodiment. In the second preferred embodiment, each of the clamping members 21 has a saw-toothed inner surface provided with a plurality of holding teeth 212 adapted for abutting tightly against the rail 11 when the lever unit 3 is at the locked position.

Figure 13:
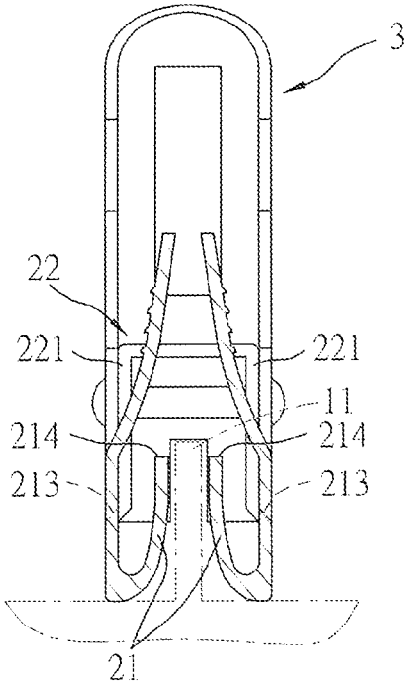
FIG. 13 is a cross-sectional view of a third preferred embodiment of the window stop device according to the present invention.

With reference to FIG. 13, a third preferred embodiment of the window stop device according to the present invention is similar to the first preferred embodiment. In the third preferred embodiment, each of the clamping members 21 is configured as a resilient plate having a connecting end 213 that is connected to a respective one of the side walls 221 of the connecting member 22 and a distal end 214 that is adapted to abut resiliently against the rail 11 when the lever unit 3 is at the locked position.

To conclude, the lever unit 3 of the window stop device according to the present invention can pivot on the restraining unit 2 to move between the locked position and the unlocked position. In the locked position, the pressing arms 31 of the lever unit 3 press on the outer surfaces of the two clamping members 21 so that the clamping members 21 clamp tightly the rail 11 therebetween. In the unlocked position, the pressing arras 31 are away from the clamping members 21 so as to release the clamping members 21 and to permit the sliding movement of the restraining unit 2 along the rail 11. Therefore, it is easy for a riser to dismount the window stop device without any tool in a short time period in case of an emergency.

While the present invention has been described in connection with what are considered the most practical and preferred embodiments, it is understood that this invention is not limited to the disclosed embodiments but is intended to cover various arrangements included within the spirit and scope or the broadest interpretation so as to encompass all such modifications and equivalent arrangements.

What is claimed is:

1. A window stop device adapted for limiting sliding movement of a window sash along a rail, said window stop device comprising:

a restraining unit including a pair of clamping members that are adapted for flanking the rail; and a lever unit connected to said restraining unit and including a pair of pressing arms that are spaced apart from each other, said lever unit, being movable relative to said restraining unit between a locked position, where said clamping members are pressed respectively by said pressing arms to clamp tightly the rail therebetween so as to position said restraining unit relative to the rail, and an unlocked position, where said pressing arms are away from said clamping members so as to release said clamping members and to permit sliding movement of said restraining unit along the rail;

wherein said lever unit further includes a connecting arm interconnecting said pressing arms and having a hole-defining surface that defines a positioning hole; and wherein said restraining unit further includes at least one guiding member connected to one of said clamping members, said guiding member extending through said positioning hole and abutting against said hole-defining surface when said lever unit is at the locked position so that said connecting arm biases resiliently said guiding member and pushes said one of said clamping members toward the other one of said clamping members.

2. The window stop device as claimed in claim 1, further comprising a pivot member that connects pivotally said lever unit to said restraining unit; wherein said restraining unit further includes a connecting member interconnecting said clamping members.

3. The window stop device as claimed in claim 1, wherein said restraining unit includes a pair of said guiding members, each of said guiding members having a fixing end section that is connected to a respective one of said clamping members, and a free end section that is distal from said fixing end section, a distance between said guiding members being smaller than a width of said positioning hole at said free end sections, gradually increasing from said free end sections toward, said fixing end sections, and being larger than the width of said positioning hole at said fixing end sections.

4. The window stop device as claimed in claim 3, wherein said restraining unit further includes a plurality of spaced-apart ribs formed on one of said guiding members, said connecting arm being engaged between an adjacent pair of said ribs when said lever unit is at the locked position.

5. The window stop device as claimed in claim 1, further comprising a buffer member connected to said restraining unit and adapted for abutting against the window sash when said lever unit is at the locked position.

6. The window stop device as claimed in claim 1, wherein each of said clamping members includes a plurality of spaced-apart holding plates adapted for abutting tightly against the rail when said lever unit is at the locked position.

7. The window stop device as claimed in claim 1, wherein each of said clamping members includes a saw-toothed inner surface provided with a plurality of holding teeth that are adapted for abutting tightly against the rail when said lever unit is at the locked position.

8. The window stop device as claimed in claim 1, wherein: said restraining unit further includes a connecting member having opposite side wails that are connected respectively to said clamping members, said connecting member being resiliently pressed by said pressing arms when said lever unit is at the locked position; and each of said clamping members is configured as a resilient plate having a connecting end that is connected to a respective one of said side walls of said connecting member, and a distal end that is adapted to abut resiliently against the rail when said lever unit is at the locked position.

* * * * *